US009397445B1

(12) United States Patent
Roman

(10) Patent No.: US 9,397,445 B1
(45) Date of Patent: Jul. 19, 2016

(54) ELECTRICAL CONNECTOR SYSTEM WITH CONNECTOR POSITION ASSURANCE

(71) Applicant: Tyco Electronics Corporation, Berwyn, PA (US)

(72) Inventor: Paul David Roman, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/687,239

(22) Filed: Apr. 15, 2015

(51) Int. Cl.

| | |
|---|---|
| ***H01R 3/00*** | (2006.01) |
| ***H01R 13/639*** | (2006.01) |
| ***H01R 13/436*** | (2006.01) |
| *H01R 13/641* | (2006.01) |
| *H01R 13/627* | (2006.01) |

(52) U.S. Cl.
CPC ..... *H01R 13/639* (2013.01); *H01R 13/4362* (2013.01); *H01R 13/6275* (2013.01); *H01R 13/641* (2013.01)

(58) Field of Classification Search
USPC ..... 439/352, 489, 752
See application file for complete search history.

(56) References Cited

U.S. PATENT DOCUMENTS

| | | | | |
|---|---|---|---|---|
| 4,746,306 A * | 5/1988 | Yurtin | H01R 13/641 | 439/352 |
| 5,207,593 A * | 5/1993 | Bogiel | H01R 13/6275 | 439/345 |
| 5,947,763 A * | 9/1999 | Alaksin | H01R 13/4362 | 439/352 |
| 6,368,164 B1 * | 4/2002 | Nakamura | H01R 13/4662 | 439/489 |
| 7,037,130 B2 * | 5/2006 | Dillon | H01R 13/6275 | 439/357 |
| 8,277,243 B1 * | 10/2012 | Hernandez | H01R 13/4362 | 439/352 |

* cited by examiner

*Primary Examiner* — Tho D Ta

(57) ABSTRACT

An electrical connector system is provided that includes a plug connector, a connector position assurance (CPA) device, and a header connector. The plug connector includes a housing and a deflectable primary latch that extends from the housing. The housing includes a lug protruding therefrom. The CPA device is mounted to the plug connector and is configured to translate relative to the plug connector. The CPA device includes a deflectable retention latch having a head at a distal end thereof. The header connector has a latching surface that engages the primary latch of the plug connector. When the plug connector mates to the header connector, a tab of the header connector deflects the retention latch of the CPA device to allow the CPA device to be translated in a locking direction beyond the lug to a locked position. The head of the retention latch blocks deflection of the primary latch.

20 Claims, 6 Drawing Sheets

ELECTRICAL CONNECTOR SYSTEM WITH CONNECTOR POSITION ASSURANCE

BACKGROUND OF THE INVENTION

The subject matter herein relates generally to an electrical connector system that has a connector position assurance device.

In some electrical connector systems, a coupling mechanism is used when a first connector is mated to a second connector to hold the first and second connectors in mating contact such that a conductive pathway is formed through the connectors. The coupling mechanism is designed to withstand forces that would pull the connectors apart and break the conductive pathway. For example, the coupling mechanism may include one or more bolts, latches, adhesives, or the like. Some electrical connector systems utilize a primary latch on one of the connectors that extends generally parallel to the mating axis of the first and second connectors and engages a latching surface of the corresponding connector.

When the primary latch is engaged, the latch is designed to prohibit unintentional uncoupling of the first and second connectors in response to a certain amount of force in the uncoupling direction. However, this function of the primary latch may fail if the primary latch does not properly engage the latching surface of the corresponding connector and/or if the applied force in the uncoupling direction exceeds a threshold allowable amount which causes the latch to deflect even if the latch is properly engaged. For example, due to a narrow clearance, it may not be possible to visually verify that the latch is properly engaged and the connectors are fully mated. As a result, there is a risk that the connectors may uncouple which breaks the conductive pathway. To ensure that the latch is properly engaged and/or to reinforce the latch, some connector systems utilize connector position assurance (CPA) devices.

Typical known CPA devices are designed to be wedged underneath the primary latch in an insertion direction that is generally parallel to the primary latch (e.g., the axis defined by the extension of the latch). The CPA device functions to block the primary latch from deflecting and disengaging the latching surface of the corresponding connector by filling the gap that the latch would deflect into. However, these CPA devices may be difficult to use with connector systems implemented in applications that have tight clearances, such as in automotive applications. For example, some known CPA devices may not have a low enough profile for use in tight clearance applications. Furthermore, the CPA devices are usually loaded from an end of the one connector in the mating direction, and there may not be enough room for such travel, whether or not the CPA device has a large profile. The mating direction of the CPA device may be parallel to the mating plane of the connectors, such that all actuation (e.g., the mating of the connectors and the loading of the CPA device) is in only one plane. This redundancy may cause a user that assembles the connector systems to overlook and improperly load the CPA device.

It is also noted that typical CPA devices are designed only to ensure that the primary latch is engaged with the latching surface of the corresponding connector and to block the deflection of the primary latch. As such, even with the CPA device, the primary latch is still the only coupling mechanism that prohibits the connectors from uncoupling. A need remains for a CPA device for an electrical connector system that addresses the problems associated with known CPA devices and also provides a secondary lock in addition to the primary latch that prohibits the connectors from uncoupling while the lock is engaged.

BRIEF DESCRIPTION OF THE INVENTION

In an embodiment, an electrical connector system includes a plug connector, a connector position assurance (CPA) device, and a header connector. The plug connector includes a housing and a deflectable primary latch. The housing extends along a plug axis between a mating end and a cable end. The primary latch extends from the housing generally parallel to the plug axis and defines a gap between the primary latch and the housing. The housing includes a lug protruding therefrom proximate to the gap. The CPA device is mounted to the plug connector and movable relative to the plug connector in a locking direction that is transverse to the plug axis. The CPA device includes a deflectable retention latch that has a head at a distal end thereof. The header connector has a cavity at a mating end that receives the mating end of the housing of the plug connector therein. The header connector has a tab proximate to the mating end. The header connector has a latching surface that engages the primary latch to form a primary lock between the plug connector and the header connector. After the plug connector is received in the cavity of the header connector, the tab of the header connector deflects the retention latch of the CPA device to allow the CPA device to be translated in the locking direction beyond the lug from an unlocked position to a locked position. In the locked position, the head of the retention latch is located in the gap and engages a first shoulder of the lug to block deflection of the primary latch.

In an embodiment, an electrical connector system includes a header connector, a plug connector, and a CPA device. The header connector has a cavity at a mating end. The header connector has a tab proximate to the mating end. The header connector also has a latching surface. The header connector includes a locking post protruding therefrom proximate to the mating end. The plug connector includes a housing and a deflectable primary latch. The housing extends along a plug axis between a mating end and a cable end. The mating end is received in the cavity of the header connector such that the primary latch engages the latching surface to form a primary lock between the plug connector and the header connector. The plug connector includes a lug protruding therefrom proximate to the primary latch. The CPA device is mounted to the plug connector and movable relative to the plug connector in a locking direction that is transverse to the plug axis. The CPA device includes a deflectable retention latch that engages a first shoulder of the lug to block the primary latch when the CPA device is in a locked position. The CPA device includes a slot. After the plug connector is received in the cavity of the header connector, the CPA device is translatable in a locking direction from an unlocked position to the locked position. The locking post is received in the slot in the locked position to form a secondary lock between the plug connector and the header connector.

In an embodiment, an electrical connector system includes a header connector, a plug connector, and a CPA device. The header connector has a cavity at a mating end. The header connector includes a locking post protruding therefrom and a tab. The header connector also has a latching surface. The plug connector includes a housing and a deflectable primary latch. The housing extends along a plug axis between a mating end and a cable end. The mating end is received in the cavity of the header connector such that the primary latch engages the latching surface to form a primary lock between the plug connector and the header connector. The primary latch extends from the housing generally parallel to the plug axis and defining a gap between the primary latch and the housing. The housing includes a lug protruding therefrom. The CPA device is mounted to the plug connector and movable relative to the plug connector in a locking direction that is transverse to the plug axis. The CPA device includes a deflectable retention latch having a head at a distal end thereof. The CPA device defines a slot. After the plug connector is received in the cavity of the header connector, the CPA device is translatable in the locking direction from an unlocked position to a locked position. In the locked position, the head of the retention latch is located in the gap and engages a first shoulder of the lug to block deflection of the primary latch. The locking post is received in the slot to form a secondary lock between the plug connector and the header connector.

DETAILED DESCRIPTION OF THE INVENTION

One or more embodiments of the inventive subject matter described herein provide an electrical connector system with a connector position assurance (CPA) device that ensures that the connectors are fully mated, reinforces a primary latch that serves as a primary lock, and provides a secondary lock to prohibit the uncoupling of the connectors when the secondary lock is engaged.

Figure 1:
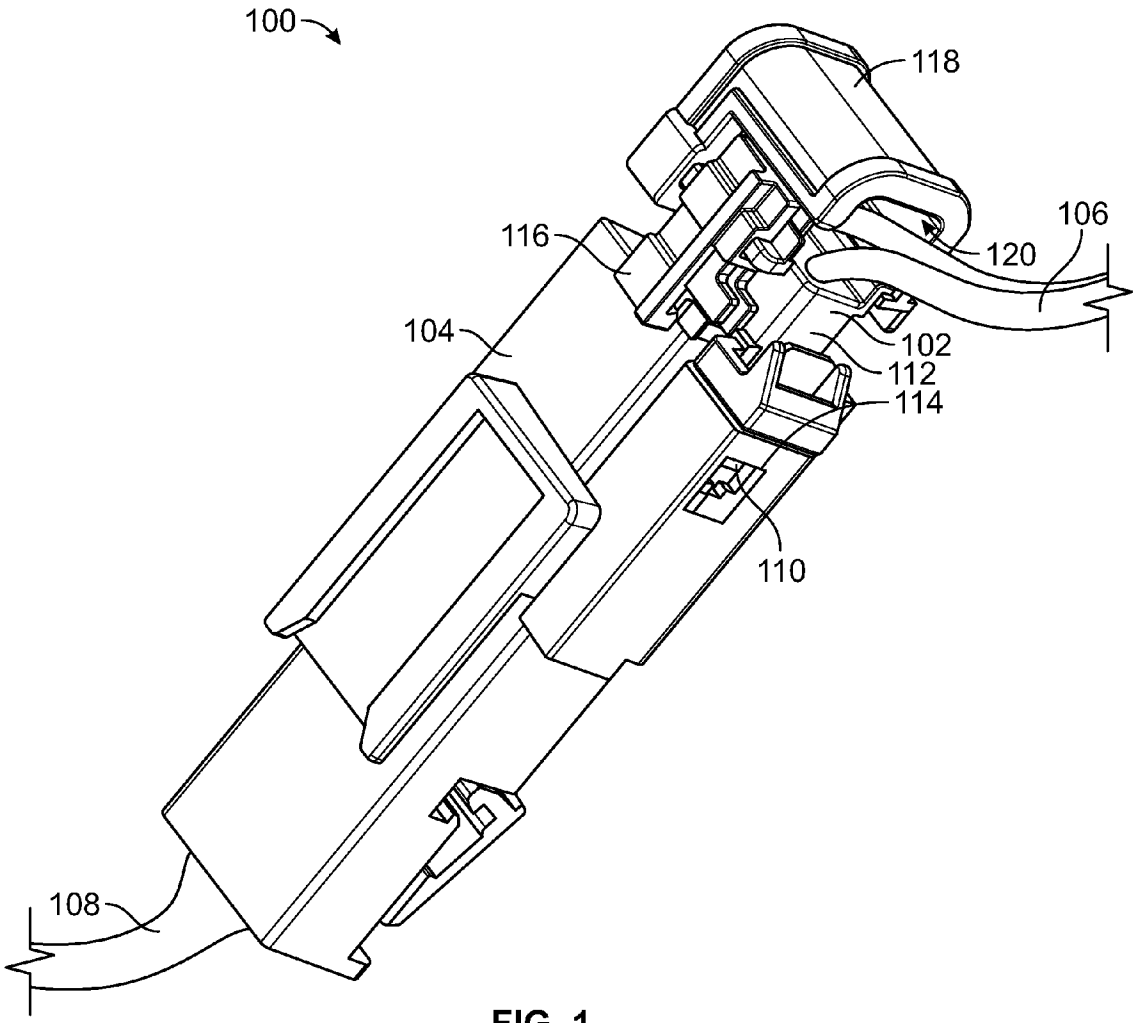
FIG. 1 is a perspective view of an electrical connector system formed in accordance with an exemplary embodiment.

FIG. 1 is a perspective view of an electrical connector system 100 formed in accordance with an exemplary embodiment. The electrical connector system 100 includes a plug connector 102 and a header connector 104 that mates with the plug connector 102. The electrical connector system 100 may be used in numerous applications within various industries, such as the automotive industry, the home appliance industry, the aviation industry, and the like, to electrically couple two or more devices. For example, in the automotive industry, the header connector 104 may be connected to a transmission, a motor, or the like, and the plug connector 102 may be connected to a power source, a database, a controller, or the like, such that electrical power signals, data, signals, and/or control signals may be transmitted to and/or from the transmission or motor when the connectors 102, 104 are mated. As shown in FIG. 1, the plug connector 102 is mated to the header connector 104 such that at least a portion of the plug connector 102 is received within the header connector 104. In alternative embodiments, the plug connector 102 may be a header connector and the header connector 104 may be a plug connector or both connectors 102, 104 may be header connectors or plug connectors.

The plug connector 102 and the header connector 104 are terminated to conductors 106, 108, respectively. The conductors 106, 108 may be conductive wires and/or cables that form conductive pathways for the transmission of electrical signals. The conductors 106, 108 may be terminated (e.g., crimped, soldered, etc.) to electrical contacts (not shown in FIG. 1). For example, the conductor 106 may be terminated to socket contacts (not shown), and the conductor 108 may be terminated to pin contacts 208 (shown in FIG. 2) that are received in the corresponding socket contacts to electrically couple the conductors 106, 108. In an alternative embodiment, the conductor 108 of the header connector 104 may be a printed circuit board instead of a wire and/or cable. When the plug connector 102 and header connector 104 are mated, one or more contacts within the plug connector 102 electrically couples to a corresponding one or more contacts within the header connector 104, which forms a conductive pathway between the conductors 106, 108. Various electrical signals, such as power, control, data, and the like, may be transmitted through the conductors 106, 108 along the conductive pathway through the connectors 102, 104 in either or both directions.

Once the plug connector 102 and header connector 104 are mated, it is important to maintain electrical coupling between the contacts (not shown) of the connectors 102, 104 to maintain the integrity of the conductive pathway that is formed between the conductors 106, 108. For example, if during use the connectors 102, 104 are at least partially pulled apart from one another, at least some of the electrical signals that are transmitted along the conductive pathway may not bridge the connectors 102, 104. As such, the signals may not be received by the intended recipient device. In addition, if the conductive pathway is broken, the electrical signals may physically damage the contacts and/or other components of the plug connector 102 and/or header connector 104.

To maintain electrical coupling between the contacts and prohibit the connectors 102, 104 from unintentionally disconnecting, the plug connector 102 has a deflectable primary latch 110 located along a housing 112 of the connector 102. The header connector 104 has a latching surface 114 that is compatible with the primary latch 110. For example, when the plug connector 102 is loaded into the header connector 104, the primary latch 110 engages the latching surface 114 to mate the plug connector 102 to the header connector 104. The engagement between the primary latch 110 and the latching surface 114 is designed to absorb and withstand forces that pull the connectors 102, 104 apart that are incidental to normal use.

The electrical connector system 100 also includes a connector position assurance (CPA) device 116. In an exemplary embodiment, the CPA device 116 is mounted to the plug connector 102. The CPA device 116 is configured to translate (e.g., move along a path from one location to another location) relative to the plug connector 102. As described herein, the CPA device 116 is configured to assure that the plug connector 102 is fully mated to the header connector 104, to reinforce the primary latch 110 by blocking its deflection away from the latching surface 114, and to provide a secondary lock that prohibits unintentional uncoupling or un-mating of the connectors 102, 104.

Optionally, the electrical connector system 100 may include a cover 118 that couples to the plug connector 102. The cover 118 may provide protection for the conductors 106 at the plug connector 102, such as to block physical contact with other devices and/or physical contaminants (e.g., dirt, sand, liquids, etc.) from entering the plug connector 102. The cover 118 may also provide electrical insulation that prohibits electrical interference from proximate electrical devices from damaging the electrical signals transmitted through the plug connector 102. The cover 118 may have at least one opening 120 through which the conductors 106 extend away from the plug connector 102 to a respective electrical device.

It should be noted that FIG. 1 is intended by way of example. In various embodiments, various aspects or structures may be omitted, modified, or added. Further, various devices, systems, or other aspects may be combined.

Figure 2:
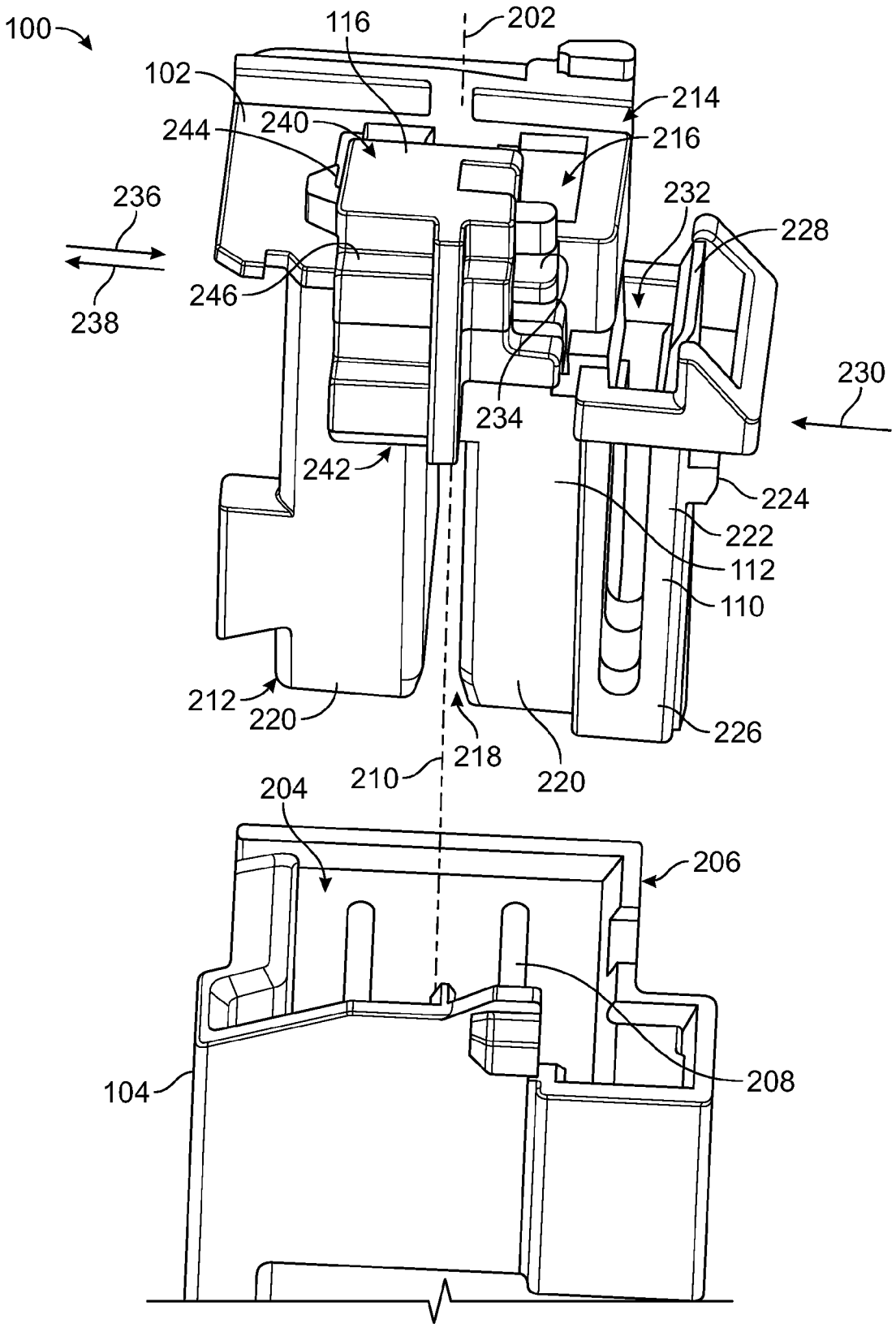
FIG. 2 is a partially exploded perspective view of an embodiment of the electrical connector system of FIG. 1.

FIG. 2 is a partially exploded perspective view of an embodiment of the electrical connector system 100 of FIG. 1. As shown in FIG. 2, the plug connector 102 is poised for mating with the header connector 104. The plug connector 102 may be mated to the header connector 104 along a mating axis 202. In an exemplary embodiment, the header connector 104 includes a cavity 204 at a mating end 206 thereof. The cavity 204 is designed to receive at least part of the plug connector 102 therein when the plug connector 102 is being mated to the header connector 104.

The header connector 104 may also include at least one header contact 208 disposed within the cavity 204 and extending towards and/or beyond the mating end 206. There are two header contacts 208 shown in FIG. 2. The header contacts 208 may be terminated to the conductor 108 (shown in FIG. 1). The header contacts 208 may be formed of a conductive material, such as a metal or metal alloy (e.g., copper, silver, gold, aluminum, etc.), a conductive polymer, or the like. The contacts 208 may be stamped and formed from a sheet panel or may be manufactured using a different process known in the art. The header connector 104 may be formed of one or more insulating materials to provide electrical insulation to the conductive pathways (e.g., circuitry) within the cavity 204. For example, the header connector 104 may be composed of one or more plastic, rubber-like polymer, ceramic, glass, and/or the like. The connector 104 optionally may be formed by a molding process.

The housing 112 of the plug connector 102 extends along a plug axis 210 between a mating end 212 and a cable end 214. The plug axis 210 may be oriented along the mating axis 202. The mating end 212 of the plug connector 102 is received in the cavity 204 of the header connector 104 when the plug connector 102 is being mated to the header connector 104. The connectors 102, 104 may be configured such that a majority of the housing 112 of the plug connector 102 is received within the cavity 204 when the connectors 102, 104 are fully mated together. The cable end 214 of the housing 112 is configured to terminate to the conductor 106 (shown in FIG. 1). The housing 112 includes at least one circuit cavity 216 that extends along the plug axis 210 through the housing 112 between the cable end 214 and the mating end 212. Each circuit cavity 216 is configured to receive one or more conductive wires of the conductor 106 and/or contacts (not shown) terminated to the conductor 106. The housing 112 may be formed of an insulating material (e.g., one or more plastic, rubber-like polymer, ceramic, glass, and/or the like) to prohibit the wires and/or contacts within different circuit cavities 216 from electrically interfering with each other. The housing 112 optionally may define at least one space 218 between adjacent circuit silos 220, where each circuit silo 220 includes at least one circuit cavity 216. The space 218 may provide additional insulating properties. Optionally, the space 218 may be configured to receive an interior wall (not shown) disposed within the cavity 204 of the header connector 104 when the plug connector 102 is loaded into the cavity 204.

When the plug connector 102 is received within the cavity 204 of the header connector 104, the header contacts 208 are received within corresponding circuit cavities 216 through openings (not shown) at the mating end 212 of the plug connector 102. The header contacts 208 electrically couple to plug contacts (not shown) within the circuit cavities 216 when the connectors 102, 104 are fully and properly mated. As shown in FIG. 2, the header contacts 208 are pin contacts, and the plug contacts may be socket (e.g., box, receptacle, etc.) contacts that receive the pin contacts.

The deflectable primary latch 110 of the plug connector 102 includes an arm 222 and a catch 224. A base end 226 of the arm 222 extends from the housing 112. Optionally, the primary latch 110 may be integral with the housing 112 such that the latch 110 and housing 112 are formed as an integral components of the plug connector 102. In an exemplary embodiment, the base end 226 may be proximate to the mating end 212 of the housing 112, and the arm 222 extends generally parallel to the plug axis 210 such that a free tip 228 of the arm 222 is located closer to the cable end 214 of the housing 112 than the base end 226. A gap 232 is formed between the arm 222 of the primary latch 110 and the housing 112. The gap 232 provides a space into which the latch 110 may be deflected. The catch 224 protrudes from the arm 222 at a location that is between the base end 226 and the tip 228. The catch 224 is configured to engage the latching surface 114 (shown in FIG. 1) of the header connector 104 to serve as a primary lock between the plug connector 102 and the header connector 104 that retains the plug connector 102 within the cavity 204 of the header connector 104. The primary latch 110 pivots relative to the base end 226 into the gap 232 when a force is applied to the tip 228 and/or the catch 224 in a deflecting direction 230. When the primary latch 110 pivots, the catch 224 may disengage the latching surface 114, allowing the connectors 102, 104 to be moved apart (e.g., unmated).

In an exemplary embodiment, the plug connector 102 includes a track 234 that is at and/or proximate to the cable end 214. The track 234 extends transversely to the plug axis 210. For example, the track 234 may be orthogonal to the plug axis 210. The CPA device 116 mounts to the track 234 of the plug connector 102. The CPA device 116 mounts to the track 234 and is movable along the length of the track 234 relative to the plug connector 102. For example, the CPA device 116 may translate along the length of the track 234 in a locking direction 236 and/or in an opposite unlocking direction 238. The locking and unlocking directions 236, 238 are transverse to the plug axis 210. As such, the CPA device 116 may be actuated in a direction that is transverse to the orientation of the primary latch 110, which extends generally parallel to the plug axis 210.

The CPA device 116 may be composed of a plastic or other polymer. In alternative embodiments, the CPA device 116 may be a ceramic, a metal, and/or the like. In an exemplary embodiment, the CPA device 116 is at least partially pliable such that the CPA device 116 may flex when the device 116 is being mounted to the track 234 which allows the CPA device 116 to snap onto the track 234. The CPA device 116 may be formed as a single integral body 246 having a first end 240 and a second end 242 that may be opposite to the first end 240. The CPA device 116 may be mounted to the track 234 at or proximate to the first end 240, with the second end 242 disposed closer to the mating end 212 of the plug connector 102. The track 234 may include one or more planar rails that engage the CPA device 116 and define the translatable pathway. The track 234 may include a retaining wall 244 on at least one side of the CPA device 116 to block the CPA device 116 from translating too far in the locking direction 236 or unlocking direction 238. As shown in FIG. 2, the retaining wall 244 is disposed on a side of the track 234 that is opposite the primary latch 110 to block movement of the CPA device 116 in the unlocking direction 238 beyond the retaining wall 244. Optionally, the retaining wall 244 may be a surface of a retaining hook, as shown in FIG. 2.

Figure 3:
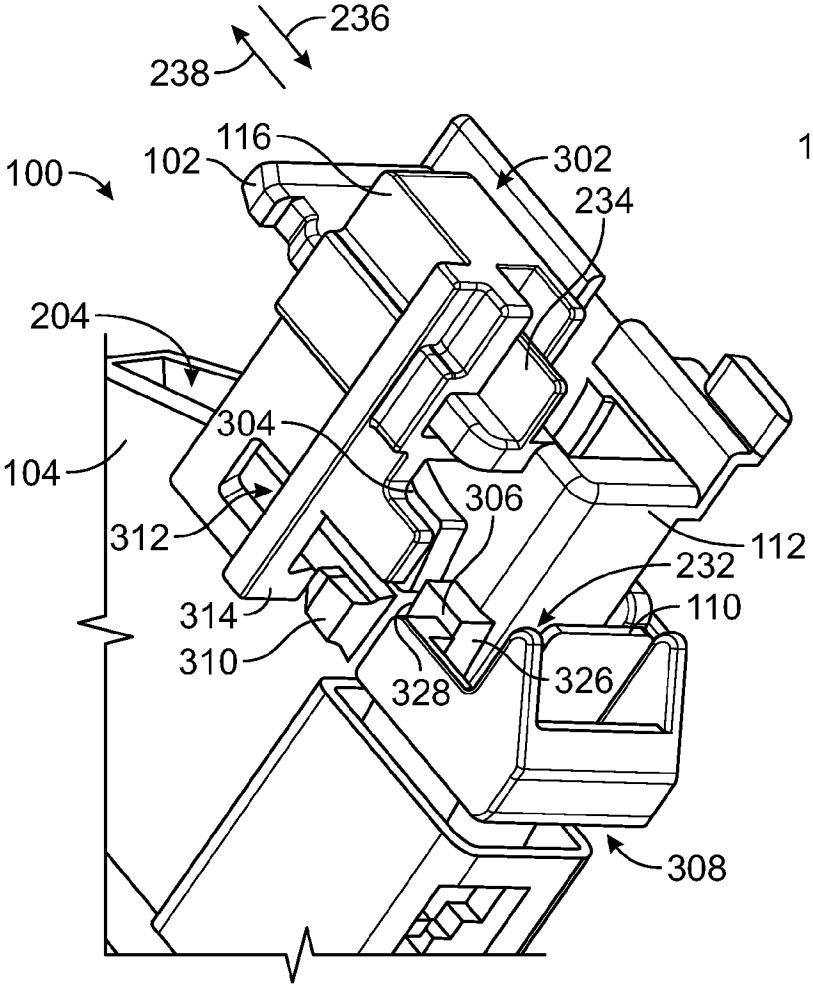
FIG. 3 is a perspective view of an embodiment of the electrical connector system of FIG. 1 showing a connector position assurance (CPA) device in an unlocked position.

FIG. 3 is a perspective view of an embodiment of the electrical connector system 100 of FIG. 1 showing the CPA device 116 in an unlocked position 302. In the unlocked position 302, the CPA device 116 does not engage the header connector 104. In addition, the CPA device 116 does not interact with the primary latch 110 in the unlocked position 302. The unlocked position 302 may be a default position, since the CPA device 116 will default to the unlocked position 302 unless the header connector 104 is at least substantially mated to the plug connector 102 and a force actuates the CPA device 116 in the locking direction 236, as described herein.

The CPA device 116 includes a retention latch 304 that is deflectable. When the retention latch 304 is undeflected, the CPA device 116 is restricted from translating in the locking direction 236 beyond a lug 306 of the plug connector 102 that contacts the latch 304. The lug 306 protrudes outward from the housing 112. In an exemplary embodiment, the lug 306 is located proximate to the gap 232 defined between the primary latch 110 and the housing 112. The lug 306 includes one or more retaining walls, such as a first shoulder 326 that faces the primary latch 110 and a second shoulder 328 on an opposite side facing the CPA device 116 when the CPA device 116 is in the unlocked position 302. In an exemplary embodiment, when the CPA device 116 is in the unlocked position 302 and the retention latch 304 is undeflected, the second shoulder 328 of the lug 306 blocks translation of the CPA device 116 in the locking direction 236, retaining the CPA device 116 in the unlocked position 302. It is noted that the CPA device 116 is also restricted on the other side by the retaining wall 244 (shown in FIG. 2), which prevents the CPA device 116 from sliding off the track 234 in the unlocking direction 238.

The electrical connector system 100 may be designed such that the header connector 104 deflects the retention latch 304 after the plug connector 102 is received in the cavity 204 of the header connector 104. In an exemplary embodiment, the plug connector 102 must be at least substantially mated or fully mated to the header connector 104 before the retention latch 304 is deflected enough to clear the lug 306 of the plug connector 102. When the retention latch 304 clears the lug 306, the CPA device 116 is no longer restricted from translation in the locking direction 236 by the lug 306. As shown in FIG. 3, the plug connector 102 is not fully received within the cavity 204 of the header connector 104 such that a crack or void 308 is present between the header connector 104 and the plug connector 102. Since the connectors 102, 104 are not substantially and/or fully mated, the retention latch 304 shown in FIG. 3 is not deflected out of the plane of the lug 306 (e.g., the latch 304 does not clear the lug 306), such that the latch 304 contacts the lug 306 to restrict movement in the locking direction 236.

In addition or alternatively, when the connectors 102, 104 are not fully mated, the CPA device 116 may be restricted from translation in the locking direction 236 by a locking post 310 that protrudes from the header connector 104. As described herein, the CPA device 116 may define a slot 312 that is configured to receive the locking post 310 when the connectors 102, 104 are fully mated. However, if the connectors 102, 104 are not fully mated, as in FIG. 3, the locking post 310 may engage a first side 314 of the CPA device 116 instead of aligning with the slot 312, which blocks further movement of the CPA device 116 in the locking direction 236. As such, whether due to contact with the locking post 310 and/or the lug 306, movement of the CPA device 116 in the locking direction 236 is restricted when the plug connector 102 and the header connector 104 are not mated. Thus, in use, the CPA device 116 in the unlocked position 302 being blocked from translation in the locking direction 236 indicates to a user that the connectors 102, 104 are not at least substantially fully mated to each other yet, and the plug connector 102 needs to be received further into the cavity 204 of the header connector 104.

Figure 4:
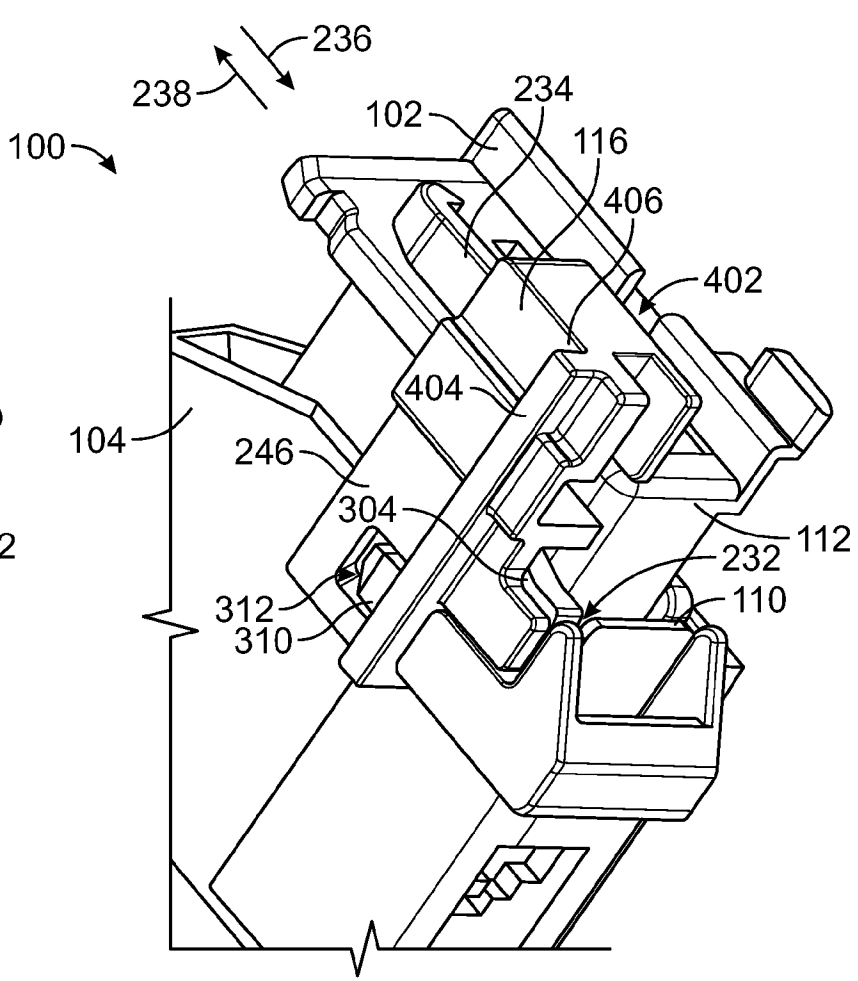
FIG. 4 is a perspective view of an embodiment of the electrical connector system showing the CPA device in a locked position.

FIG. 4 is a perspective view of an embodiment of the electrical connector system 100 showing the CPA device 116 in a locked position 402. The locked position 402 is more proximate to the primary latch 110 than the unlocked position 302 (shown in FIG. 3). In an exemplary embodiment, the CPA device 116 reinforces the primary latch 110 when in the locked position 402. For example, the retention latch 304 of the CPA device 116 is disposed within the gap 232 between the primary latch 110 and the housing 112. The CPA device 116 reinforces the primary latch 110 because the retention latch 304 within the gap 232 restricts the primary latch 110 from deflection into the gap 232. For example, if a force is applied to the primary latch 110 that would ordinarily cause the latch 110 to deflect into the gap 232, when the CPA device 116 is in the locked position 402, the retention latch 304 contacts the primary latch 110 to block deflection of the primary latch 110. Since the primary latch 110 serves as the primary lock between the connectors 102, 104, the CPA device 116 in the locked position 402 prohibits unmating of the connectors 102, 104.

In an exemplary embodiment, when the CPA device 116 is translated in the locking direction 236 to the locked position 402, the locking post 310 of the header connector 104 is received in the slot 312 of the CPA device 116. The interaction between the CPA device 116 and the locking post 310 within the slot 312 forms a secondary lock between the connectors 102, 104. For example, the locking post 310 may be an integral, fixed component of the header connector 104, such that the header connector 104 does not move relative to the locking post 310. The slot 312 is defined in the body 246 of the CPA device 116, which is mounted to the plug connector 102. Therefore, when the locking post 310 is received within the slot 312, the CPA device 116 holds the positions of the connectors 102, 104 relative to each other. In addition, since the electrical connector system 100 may be configured such that the locking post 310 is only received within the slot 312 of the CPA device 116 when the connectors 102, 104 are at least substantially fully mated, the CPA device 116 in the locked position 402 retains the connectors 102, 104 in the mated position. This secondary lock may support the primary lock formed by the primary latch 110, such that the secondary lock absorbs at least some forces applied in the unmating direction. This secondary lock may also serve as a backup lock in case the primary lock fails due to damaged or malformed components or the like.

In order to reach the locked position 402, the CPA device 116 is translated in the locking direction 236 from the unlocked position 302 (shown in FIG. 3) along the track 234.

In an exemplary embodiment, the CPA device 116 includes a rib 404 on an outer surface 406 thereof. The rib 404 may extend parallel to the plug axis 210 (shown in FIG. 2). The rib 404 provides a gripping feature for a user to engage in order to force the CPA device 116 to translate in the locking direction 236 from the unlocked position 302 to the locked position 402. The rib 404 also may be used to translate the CPA device 116 in the unlocking direction 238 from the locked position 402 to the unlocked position 302, such as when the user desires to disconnect the connectors 102, 104.

The CPA device 116 is restricted from movement in the locking direction 236 unless the header connector 104 deflects the retention latch 304 enough to clear the lug 306 (shown in FIG. 3), which allows the CPA device 116 to be translated in the locking direction 236 beyond the lug 306. Therefore, movement along two different, transverse axes or planes is necessary for the CPA device 116 to reach the locked position 402. First, the connectors 102, 104 must be moved relative to each other along the mating axis 202 (shown in FIG. 2) in a mating direction far enough that the retention latch 304 is deflected a sufficient amount to clear the lug 306 of the plug connector 102 and/or far enough that the locking post 310 of the header connector 104 aligns with the slot 312. As shown in FIG. 4, the header connector 104 and the plug connector 102 are fully mated such that little or no space (e.g., void 308 shown in FIG. 3) is present at the interface between the connectors 102, 104. Second, the CPA device 116 must be moved in the locking direction 236, which is transverse to the mating axis 202. Optionally, the locking direction 236 may be perpendicular to the mating axis 202.

As described above with reference to FIG. 2, the primary latch 110 may extend at least generally parallel to the plug axis 210 and the mating axis 202. Typical known CPA devices are inserted underneath a primary latch along the same plane of the latch, such that all loading (e.g., the connectors to each other and the CPA device to the plug connector) occurs along the same axis. Actuating the CPA device 116 in a direction transverse to the plug axis 210 and plane of the primary latch 110 requires an intentional affirmative act by the user, which may be non-intuitive. This affirmative act of translating the CPA device 116 transverse to the plug axis 210 may ensure that the user properly locates the CPA device 116 to block deflection of the primary latch 110 and to ensure that the connectors 102, 104 are fully mated.

In addition, actuation of the CPA device 116 transverse to the plug axis 210 (shown in FIG. 2) may conserve space in a narrow working environment. For example, the electrical connector system 100 may be used in an automotive application, where the compartment that houses the connector system 100 has little clearance and/or has little accessibility. Thus, with typical known CPA devices that are loaded beneath the primary latch in a direction parallel to the latch from an end of the connector, there may not be enough space, or at least accessible space, at the end of the connector to load to the CPA device. The CPA device 116 described herein is already mounted to the plug connector 102 and has a low profile. Loading the CPA device 116 by translating the device 116 in the locking direction 236 does not require any additional space at the end of the connector 102. The user merely needs enough space to engage the CPA device 116. The user does not need to visually verify that the primary latch 110 is engaged with the latching surface 114 (shown in FIG. 1) of the header connector 104 because the user is able to tell whether or not the connectors 102, 104 are mated by whether or not the CPA device 116 is restricted from movement in the locking direction 236 to the locked position 402.

Figure 5B:
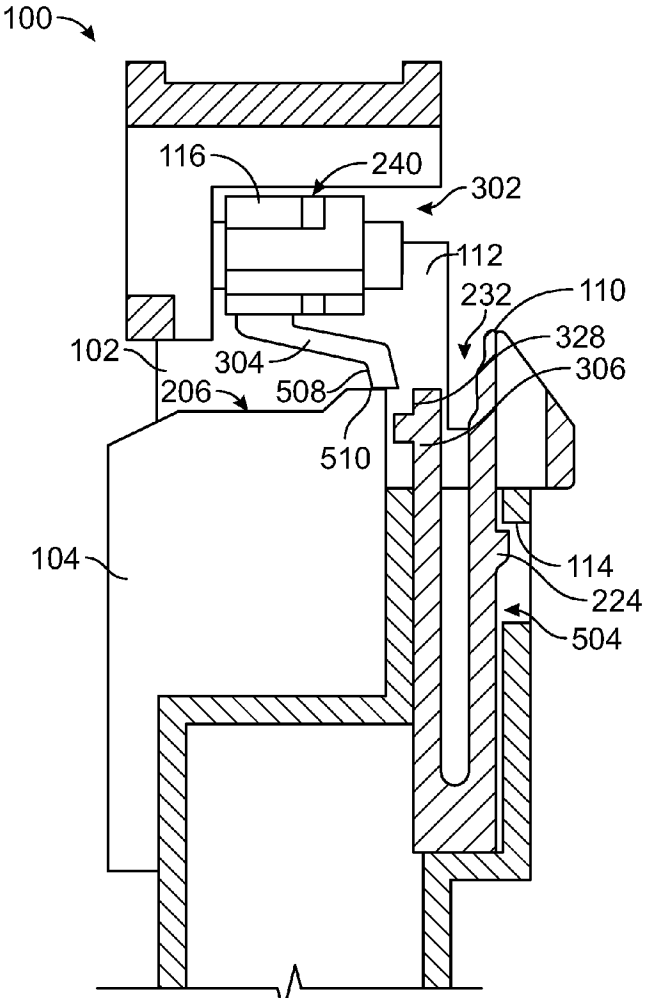
FIG. 5B is a cross-section of the electrical connector system shown in FIG. 5A showing the header connector mated to the plug connector and a CPA device in an unlocked position.
Figure 5A:
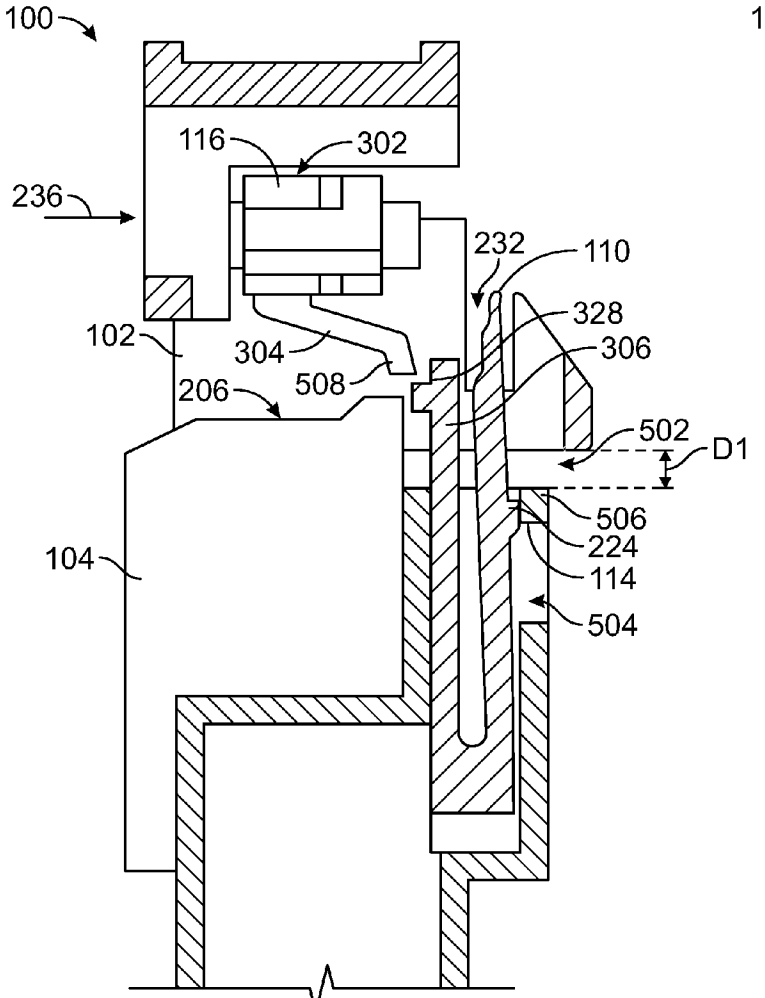
FIG. 5A is a cross-section of an embodiment of the electrical connector system of FIG. 1 showing a header connector not mated to a plug connector.

FIG. 5A is a cross-section of an embodiment of the electrical connector system 100 of FIG. 1 showing the header connector 104 not mated to the plug connector 102. In FIG. 5A, the connectors 102, 104 may be in the process of mating or uncoupling, or may be stationary but not fully mated. The connectors 102, 104 are separated from each other by a crack or void 502 of distance D1. Since the connectors 102, 104 are not fully mated, the primary latch 110 is not engaged with the latching surface 114 of the header connector 104. More specifically, the catch 224 of the latch 110 is not received in a groove of the header connector 104. As shown in FIG. 5A, the groove is a window 504 (e.g., a locking window) that extends through a wall 506 (e.g., a locking wall) of the header connector 104. The latching surface 114 defines a top of the window 504 proximate to the mating end 206 of the header connector 104. Since the catch 224 is not within the window 504, the wall 506 of the header connector 104 contacts the catch 224 and deflects the latch 110 into the gap 232.

The CPA device 116 in FIG. 5A is in the unlocked position 302. The retention latch 304 of the CPA device 116 is undeflected. The retention latch 304 includes a head 508 (e.g., latch head 508) at a distal, free end of the latch 304. In an exemplary embodiment, the CPA device 116 is restricted from movement in the locking direction 236 because the head 508 of the retention latch 304 contacts the second shoulder 328 of the lug 306 of the plug connector 102.

FIG. 5B is a cross-section of the electrical connector system 100 shown in FIG. 5A showing the header connector 104 mated to the plug connector 102 and the CPA device 116 in the unlocked position 302. Since the connectors 102, 104 are mated, the catch 224 of the primary latch 110 is received in the window 504. The primary lock is formed because the catch 224 engages the latching surface 114 of the header connector 104 to prohibit the connectors 102, 104 from being moved apart from each other (e.g., unmated). With the catch 224 received in the window 504, the primary latch 110 is undeflected, so the gap 232 between the latch 110 and the housing 112 is wider than when the latch 110 is deflected, as shown in FIG. 5A.

In an exemplary embodiment, the header connector 104 includes a tab 510 that is proximate to the mating end 206 of the connector 104. The tab 510 may extend from the header connector 104 in the direction towards the CPA device 116 such that the tab 510 defines a portion of the mating end 206. As the plug connector 102 is loaded into the header connector 104, the tab 510 engages the retention latch 304 and deflects the latch 304 in the direction towards the first (e.g., top) end 240 of the CPA device 116. For example, the tab 510 may contact the latch head 508. As shown in FIG. 5B, when the connectors 102, 104 are mated, the latch head 508 is deflected upwards (e.g., towards the top end 240) to a point above the lug 306. Therefore, the CPA device 116 is not restricted from movement in the locking direction 236 (shown in FIG. 5A) by the second shoulder 328 of the lug 306 because the latch 304 passes above the lug 306 without contacting the second shoulder 328.

In an exemplary embodiment, the electrical connector system 100 may be designed such that the tab 510 does not deflect the retention latch 304 to a point that allows the latch 304 to clear the second shoulder 328 of the lug 306 until the connectors 102, 104 are at least substantially fully mated to each other. In this way, the CPA device 116 may be used as an indicator of whether the connectors 102, 104 are mated or not, since the CPA device 116 is not translatable in the locking direction 236 (shown in FIG. 5A) until the connectors 102, 104 are mated.

In an alternative embodiment, the tab 510 and the locking post 310 (shown in FIG. 3) may not be separate components of the header connector 104. For example, the tab 510 may be the locking post 310, such that the locking post 310 deflects the retention latch 304 when the connectors 102, 104 are mated to allow the CPA device to translate relative to the lug 306. In addition to deflecting the retention latch 304, the locking post 310 may be received in the slot 312 (shown in FIG. 3) to form a secondary lock between the connectors 102, 104.

Figure 5C:
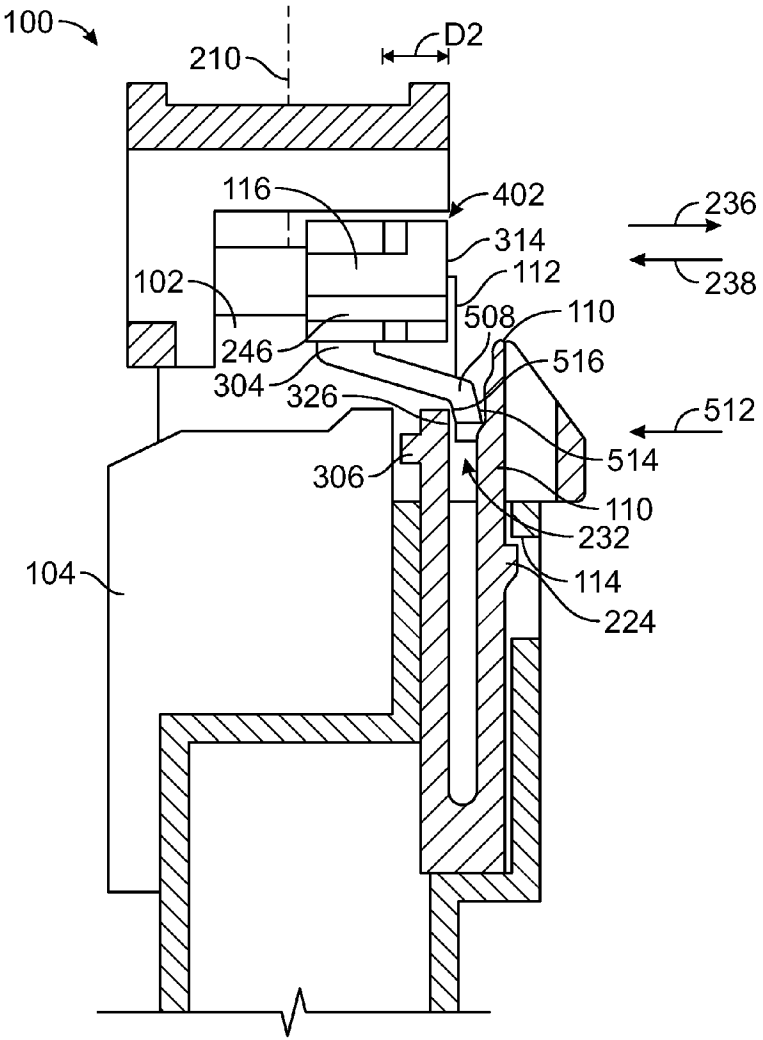
FIG. 5C is a cross-section of the electrical connector system shown in FIGS. 5A and 5B showing the header connector mated to the plug connector and the CPA device in a locked position.

FIG. 5C is a cross-section of the electrical connector system 100 shown in FIGS. 5A and 5B showing the header connector 104 mated to the plug connector 102 and the CPA device 116 in the locked position 402. In comparison to FIG. 5B, the connectors 102, 104 have not moved relative to each other. The only displacement has occurred with the CPA device 116, which has translated from the unlocked position 302 (shown in FIG. 5B) in the locking direction 236 to the locked position 402. Between the unlocked position 302 and the locked position 402, the CPA device 116 may travel a distance D2, shown in FIG. 5C as the displacement of the first side 314 of the CPA device 116.

In the locked position 402, the retention latch 304 may be undeflected. The latch head 508 is located in the gap 232 between the primary latch 110 and the housing 112 of the plug connector 102. The latch head 508 may engage the first shoulder 326 of the lug 306 to block deflection of the primary latch 110. For example, if the primary latch 110 is forced in a deflecting direction 512, the primary latch 110 may contact the latch head 508. The latch head 508 may be sandwiched in the gap 232 between the first shoulder 326 of the lug 306 and the retention latch 304, which blocks the primary latch 110 from further deflection in the deflecting direction 512. The electrical connector system 100 may be configured such that when the CPA device 116 is in the locked position 402, the primary latch 110 is not allowed to deflect to an extent that the catch 224 disengages from the latching surface 114 of the header connector 104. Therefore, the CPA device 116 reinforces the primary lock formed by the engagement of the primary latch 110 with the latching surface 114.

The head 508 of the retention latch 304 may have a first side 514 that faces the primary latch 110 and an opposite second side 516 that faces the housing 112 and/or lug 306. The first and second sides 514, 516 may or may not be sloped relative to the plug axis 210. In an exemplary embodiment, the first and second sides 514, 516 of the latch head 508 are sloped with a reclined (e.g., backward inclined, tilted backward, etc.) angle relative to the plug axis 210. The sides 514, 516 are reclined such that the distal tips of the sides 514, 516 are located closer to the primary latch 110 than the bases of the sides 514, 516 that are closer to the body 246 of the CPA device 116. Optionally, the first shoulder 326 of the lug 306 may be reclined as well.

When the CPA device 116 is in the locked position 402, a force on the body 246 of the CPA device 116 in the unlocking direction 238 forces the second side 516 of the latch head 508 against the first shoulder 326 of the lug 306. If the force is of sufficient magnitude, the retention latch 304 may deflect to allow the side 516 of the latch head 508 to slide relative to the shoulder 326 of the lug 306 such that the latch head 508 ramps over the lug 306. If the side 516 and/or the shoulder 326 are reclined, less force may be required for the surfaces 516 and 326 to slide relative to each other to allow the latch head 508 to ramp over lug 306. Thus, the CPA device 116 may be actuated in the unlocking direction 238 with less force than if neither of the surfaces 516 or 326 is reclined, and less torque on the retention latch 304 may make the CPA device 116 to be more durable.

Although the reclined angles may decrease the required force applied to the body 246 of the CPA device 116 to unlock the CPA device 116, the force required for the primary latch 110 to unlock the CPA device 116 may not be changed or may even be increased by the reclined angles. For example, a force applied to the primary latch 110 in the deflecting direction 512 causes the latch 110 to pivot into contact with the first side 514 of the latch head 508. If the side 514 is reclined, the force applied from the primary latch 110 pivoting into the latch head 508 may be generally normal to the reclined surface, which forces the latch head 508 at least partially downward against the shoulder 326 of the lug 306. As such, instead of allowing the latch head 508 to ramp up the shoulder 326 of the lug 306, a force applied to the latch head 508 by the primary latch 110 may merely wedge the latch head 508 between the latch 110 and the lug 306. Thus, if at least one of the first shoulder 326 of the lug 306, the first side 514 of the latch head 508, or the second side 516 of the latch head 508 are reclined, the force required to unlock the CPA device 116 by engaging the body 246 of the CPA device 116 may be decreased while not simultaneously not reducing the force required to unlock the CPA device 116 by engaging the primary latch 110.

Figure 6:
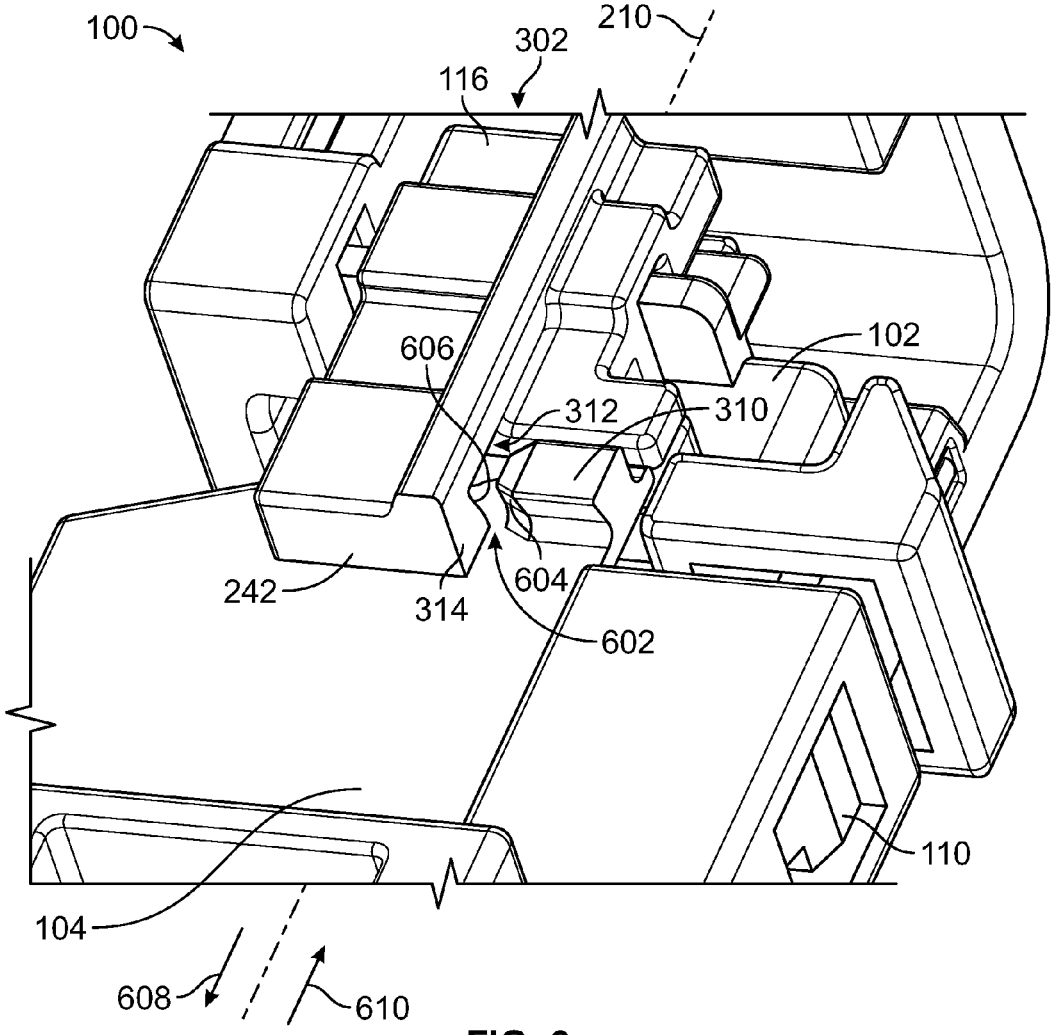
FIG. 6 is a perspective view of a section of the electrical connector system of FIG. 1 according to an embodiment.

FIG. 6 is a perspective view of a section of the electrical connector system 100 of FIG. 1 according to an embodiment. The slot 312 of the CPA device 116 extends transversely to the plug axis 210. For example, the slot 312 may extend perpendicularly to the plug axis 210. The slot 312 extends into the CPA device 116 from an opening 602 in the first side 314 of the CPA device 116. The locking post 310 of the header connector 104 is received in the slot 312 through the opening 602 when the CPA device 116 is translated from the unlocked position 302 to the locked position 402 (shown in FIG. 4). The locking post 310 within the slot 312 of the CPA device 116 forms a secondary lock that, in addition with the primary lock formed in part by the primary latch 110, retains the mating of the connectors 102, 104.

In an exemplary embodiment, the locking post 310 includes an angled guide region 604. The guide region 604 may be a tapered lead-in surface that enters the slot 312 first. The guide region 604 may engage a side wall 606 that at least partially defines the slot 312. The side wall 606 may be proximate to the second (e.g., bottom) end 242 of the CPA device 116. As the tapered surface of the guide region 604 engages the side wall 606, the header connector 104 and the plug connector 102 may be forced further towards each other to ensure that the connectors 102, 104 are fully mated. For example, as the CPA device 116 is translated over the guide region 604 of the locking post 310, the CPA device 116 may be pulled downward in a plug mating direction 608. Since the CPA device 116 is mounted to the plug connector 102, the CPA device 116 forces the plug connector 102 downward in the mating direction 608 as well, further into the cavity 204 (shown in FIG. 2) of the header connector 104. In addition or alternatively, when the CPA device 116 translates over the guide region 604, the side wall 606 may pull the locking post 310 upward in a header mating direction 610 relative to the plug connector 102. In either case, the connectors 102, 104 are forced further together.

Prior to actuating the CPA device 116 in the locking direction 236 (shown in FIG. 2), the connectors must at least be substantially mated in order for the movement of the CPA device 116 to not be restricted by the lug 306 (shown in FIG. 3). However, the interaction between the guide region 604 of the locking post 310 and the side wall 606 of the CPA device 116 may provide an additional pull on the connectors 102, 104 to eliminate any slight gaps or looseness and ensure that the connectors 102, 104 are fully and soundly mated.

Figure 7:
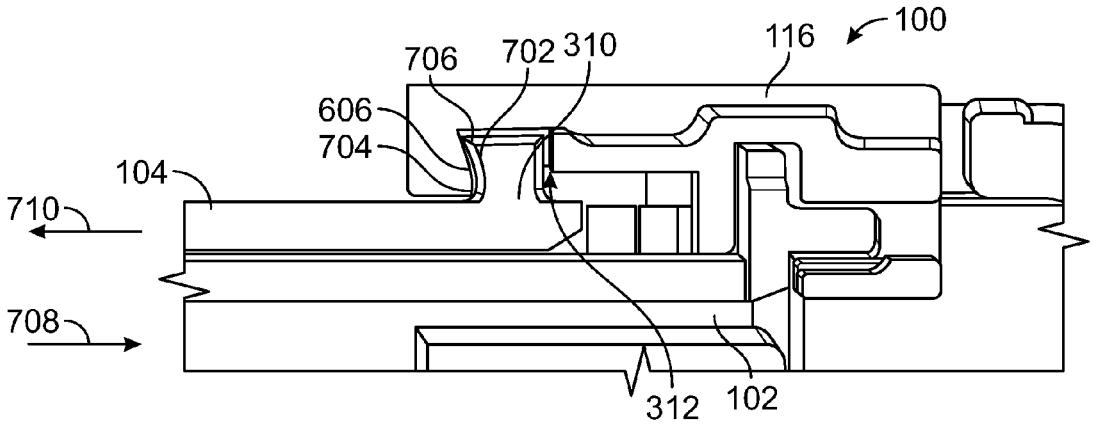
FIG. 7 is a cross-section of the section of the electrical connector system shown in FIG. 6.

FIG. 7 is a cross-section of the section of the electrical connector system 100 shown in FIG. 6. In an exemplary embodiment, the side wall 606 of the CPA device 116 that at least partially defines the slot 312 and a side 702 of the locking post 310 that faces and/or engages the side wall 606 have corresponding shapes. For example, the side wall 606 and the side 702 may have corresponding dovetail features that are sloped to partially lock onto each other. Thus, as the CPA device 116 is translated over the locking post 310, an inner edge 704 of the side wall 606 that is adjacent to a surface of the header connector 104 may pass underneath a distal edge 706 of the side 702 of the locking post 310. These sloped surfaces of the side wall 606 and the side 702 of the locking post 310 prohibit the CPA device 116 and/or the locking post 310 from deflecting and disengaging the other component when a force in an unmating or disconnecting direction is applied. Such force may be applied to the CPA device 116 and/or the plug connector 102 in a plug unmating direction 708 and/or to the header connector 104 in a header unmating direction 710.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector system comprising:

a plug connector including a housing and a deflectable primary latch, the housing extending along a plug axis between a mating end and a cable end, the primary latch extending from the housing generally parallel to the plug axis and defining a gap between the primary latch and the housing, the housing including a lug protruding therefrom proximate to the gap;

a connector position assurance (CPA) device mounted to the plug connector and movable relative to the plug connector in a locking direction that is transverse to the plug axis, the CPA device including a deflectable retention latch having a head at a distal end thereof; and a header connector having a cavity at a mating end that receives the mating end of the housing of the plug connector therein, the header connector having a tab proximate to the mating end, and the header connector having a latching surface that engages the primary latch to form a primary lock between the plug connector and the header connector;

wherein, after the plug connector is received in the cavity of the header connector, the tab of the header connector deflects the retention latch of the CPA device to allow the CPA device to be translated in the locking direction beyond the lug from an unlocked position to a locked position, wherein, in the locked position, the head of the retention latch is located in the gap and engages a first shoulder of the lug to block deflection of the primary latch.

2. The electrical connector system of claim 1, wherein, when the CPA device is in the unlocked position and the retention latch is undeflected, the CPA device is not movable in the locking direction because a second shoulder of the lug of the plug connector contacts the head of the retention latch.

3. The electrical connector system of claim 1, wherein the tab is configured to not deflect the retention latch of the CPA device until the header connector is at least substantially mated to the plug connector to ensure that the plug connector is properly received in the header connector.

4. The electrical connector system of claim 1, wherein the housing of the plug connector includes a track proximate to the cable end that extends transversely to the plug axis, the CPA device is mounted to the track and is translatable along the length of the track in the locking direction and in an opposite unlocking direction.

5. The electrical connector system of claim 1, wherein the CPA device defines a slot that extends transversely to the plug axis from an opening at a first side of the CPA device, the header connector includes a locking post protruding therefrom that is received in the slot through the opening when the CPA device is translated in the locking direction to form a secondary lock between the plug connector and the header connector.

6. The electrical connector system of claim 5, wherein the locking post includes an angled guide region that provides a lead-in surface, the guide region engages a side wall defining the slot of the CPA device when the CPA device is translated in the locking direction to pull the header connector and the plug connector towards each other to ensure that the header connector and the plug connector are fully mated.

7. The electrical connector system of claim 5, wherein a side wall defining the slot of the CPA device and a side of the locking post that engages the side wall each have corresponding dovetail features that are sloped to prohibit the CPA device from disengaging the locking post when a force in an unmating direction is applied to at least one of the plug connector, the CPA device, or the header connector.

8. The electrical connector system of claim 1, wherein the CPA device includes a rib on a surface thereof, the rib extends parallel to the plug axis and provides a gripping feature for a user to engage to translate the CPA device in at least one of the locking direction or an opposite unlocking direction.

9. The electrical connector system of claim 1, wherein the head of the retention latch is sloped with a reclined angle such that, when the CPA device is in the locked position, a force applied to the CPA device in an unlocking direction deflects the retention latch relative to the first shoulder of the lug but a force applied to the head from the primary latch in the unlocking direction does not deflect the retention latch.

10. An electrical connector system comprising:

a header connector having a cavity at a mating end, the header connector having a tab proximate to the mating end, the header connector having a latching surface, and the header connector including a locking post protruding therefrom proximate to the mating end;

a plug connector including a housing and a deflectable primary latch, the housing extending along a plug axis between a mating end and a cable end, the mating end received in the cavity of the header connector such that the primary latch engages the latching surface to form a primary lock between the plug connector and the header connector, the plug connector including a lug protruding therefrom proximate to the primary latch; and a connector position assurance (CPA) device mounted to the plug connector and movable relative to the plug connector in a locking direction that is transverse to the plug axis, the CPA device including a deflectable retention latch that engages a first shoulder of the lug to block the primary latch when the CPA device is in a locked position, the CPA device including a slot;

wherein, after the plug connector is received in the cavity of the header connector, the CPA device is translatable in the locking direction from an unlocked position to the locked position, the locking post being received in the slot in the locked position to form a secondary lock between the plug connector and the header connector.

11. The electrical connector system of claim 10, wherein the locking post includes an angled guide region that provides a lead-in surface, the guide region engages a side wall defining the slot of the CPA device when the CPA device is translated in the locking direction to pull the header connector and the plug connector towards each other to ensure that the header connector and the plug connector are fully mated.

12. The electrical connector system of claim 10, wherein a side wall defining the slot of the CPA device and a side of the locking post that engages the side wall each have corresponding dovetail features that are sloped to prohibit the CPA device from disengaging the locking post when a force in an unmating direction is applied to at least one of the plug connector, the CPA device, or the header connector.

13. The electrical connector system of claim 10, wherein, when the CPA device is in the unlocked position and the retention latch is undeflected, the CPA device is not movable in the locking direction because a second shoulder of the lug of the plug connector contacts a head of the retention latch, the head disposed at a distal end of the retention latch.

14. The electrical connector system of claim 10, wherein the CPA device includes a rib on a surface thereof, the rib extends parallel to the plug axis and provides a gripping feature for a user to engage to translate the CPA device in at least one of the locking direction or an opposite unlocking direction.

15. The electrical connector system of claim 10, wherein a head of the retention latch that is disposed at a distal end of the retention latch is sloped with a reclined angle such that, when the CPA device is in the locked position, a force applied to the CPA device in an unlocking direction deflects the retention latch relative to the first shoulder of the lug but a force applied to the head from the primary latch in the unlocking direction does not deflect the retention latch.

16. An electrical connector system comprising:

a header connector having a cavity at a mating end, the header connector including a locking post protruding therefrom and a tab, the header connector having a latching surface;

a plug connector including a housing and a deflectable primary latch, the housing extending along a plug axis between a mating end and a cable end, the mating end received in the cavity of the header connector such that the primary latch engages the latching surface to form a primary lock between the plug connector and the header connector, the primary latch extending from the housing generally parallel to the plug axis and defining a gap between the primary latch and the housing, the housing including a lug protruding therefrom; and a connector position assurance (CPA) device mounted to the plug connector and movable relative to the plug connector in a locking direction that is transverse to the plug axis, the CPA device including a deflectable retention latch having a head at a distal end thereof, the CPA device defining a slot;

wherein, after the plug connector is received in the cavity of the header connector, the CPA device is translatable in the locking direction from an unlocked position to a locked position, wherein, in the locked position, the head of the retention latch is located in the gap and engages a first shoulder of the lug to block deflection of the primary latch and the locking post is received in the slot to form a secondary lock between the plug connector and the header connector.

17. The electrical connector system of claim 16, wherein, when the CPA device is in the unlocked position and the retention latch is undeflected, the CPA device is not movable in the locking direction because a second shoulder of the lug of the plug connector contacts the head of the retention latch.

18. The electrical connector system of claim 16, wherein the tab is configured to not deflect the retention latch of the CPA device to allow the CPA device to be translated to the locked position until the header connector is at least substantially mated to the plug connector to ensure that the plug connector is properly received in the header connector.

19. The electrical connector system of claim 16, wherein the locking post includes an angled guide region that provides a lead-in surface, the guide region engages a side wall defining the slot of the CPA device when the CPA device is translated in the locking direction to pull the header connector and the plug connector towards each other to ensure that the header connector and the plug connector are fully mated.

20. The electrical connector system of claim 16, wherein the head of the retention latch is sloped with a reclined angle such that, when the CPA device is in the locked position, a force applied to the CPA device in an unlocking direction deflects the retention latch relative to the first shoulder of the lug but a force applied to the head from the primary latch in the unlocking direction does not deflect the retention latch.

* * * * *